United States Patent [19]

Insulan et al.

[11] 4,227,262

[45] * Oct. 14, 1980

[54] PROTECTIVE SUIT WITH INSULATED HEAD PIECE

[75] Inventors: Stig G. E. Insulan, Brasted, Sweden; Jorn Stubdal, Fagerstrand, Norway

[73] Assignee: Viking-Askim A/S, Norway

[ * ] Notice: The portion of the term of this patent subsequent to Jan. 30, 1996, has been disclaimed.

[21] Appl. No.: 960,599

[22] Filed: Nov. 14, 1978

Related U.S. Application Data

[63] Continuation-in-part of Ser. No. 831,557, Sep. 8, 1977, Pat. No. 4,136,402.

[30] Foreign Application Priority Data

Sep. 9, 1976 [NO] Norway ..... 763090

[51] Int. Cl.[2] ..... B63C 11/04

[52] U.S. Cl. ..... 2/2.1 R; 2/82

[58] Field of Search ..... 2/2, 2.1 R, 2.1 A, 82; 128/141 R, 142.5, 142.7, 400

[56] References Cited

U.S. PATENT DOCUMENTS

| | | | |
|---|---|---|---|
| 2,570,019 | 10/1951 | Wolk | 2/2.1 R |
| 3,391,405 | 7/1968 | Wiswell, Jr. | 2/2.1 R |
| 3,428,960 | 2/1969 | Schueller | 2/2.1 R |
| 3,731,319 | 5/1973 | O'Neill | 2/2.1 R |
| 4,136,402 | 1/1979 | Insulan et al. | 2/2.1 R |

*Primary Examiner*—C. J. Husar
*Assistant Examiner*—Moshe I. Cohen
*Attorney, Agent, or Firm*—Saul Jecies

[57] ABSTRACT

A protective suit—for diving, gas protection and rescue work—has a body of flexible elastically yieldable material and a head gear in form of a flexible elastically yieldable hood having an inner and an outer wall which defines therebetween a clearance for a layer of thermally insulating air or gas.

21 Claims, 6 Drawing Figures

PROTECTIVE SUIT WITH INSULATED HEAD PIECE

This application is a Continuation-in-Part Application of the co-pending Application Ser. No. 831,557 filed Sept. 8, 1977 now U.S. Pat. No. 4,136,402, issued Jan. 30, 1979.

BACKGROUND OF THE INVENTION

This invention relates to protective suit.

More particularly, the invention relates to a protective suit of a type suitable for diving, gas protection, rescue work and similar applications.

Still more particularly, the invention relates to such a suit which is worn in inflated condition, that is, at internal air/gas pressure which is preferably in excess of ambient pressure.

Various types of materials are used for diving suits, depending on the nature and extent of the diving.

There are both dry and wet diving suits. The former are made of, for instance, rubber-coated textile, whereas wet suits are made of expanded neoprene or natural rubber mainly on the outside and reinforced by tricot on the inside.

Two types of variable-volume dry suits are known, one made of dry suit material and the other of wet suit material. With both types of suits underwear must be used for thermal insulation of the diver. Further thermal protection of the diver is achieved by admitting air/gas into the suit during the diving operation, in such a quantity that the inner pressure in the suit as a rule becomes greater than or equal to the surrounding water pressure. The buoyancy of the diver is balanced by lead weights (e.g., a weight belt).

As regards the present variable volume suits, that part of the suit that may be thus put under overpressure is terminated at the neck. Therefore, the head region does not have any thermal protection other than that which is afforded by the ordinary wet suit protection.

The thermal insulation of the head and the area around the head may, accordingly, be considered inadequate. There has been no lack of ideas for the solution of this problem, but no practical solution has heretofore been proposed which combines easy applicability, sealing against the outer and inner surroundings, and effective thermal insulation of the head region.

Attempts have been made to employ suit hoods (head hoods) made from expanded neoprene or latex. The drawback of these hood types is that they fit closely to the head and neck, thus providing only a limited thermal protection. Besides, the expanded material becomes increasingly compressed as the diver goes deeper, the result being a reduction of the thermal insulation in case of diving to greater depths.

Efforts have been made to avoid these problems, by blowing air/gas into the hood, which for this purpose has been furnished with a lip seal in the face opening instead of the usual neck seal. However, it appears impossible to produce a face seal that may be said to be practically serviceable, as the design does not allow a sufficient overpressure in the suit.

SUMMARY OF THE INVENTION

The primary object of this invention is to provide the diver with a perfect thermal protection of the head and neck.

Another object is to provide the suit with a seal allowing an internal overpressure of about 600 mm water column (the vertical distance between the outlet valve and the top of the head when the diver assumes a vertical position in the water) and to give the suit considerable lifting capacity.

The invention offers the advantage that the suit can be used for emergency ascent (free ascent), and at the same time gives the diver considerable floating capacity in a surface position.

The purposes of the invention are achieved by furnishing the variable volume suit with an inner hood in addition to the outer hood of the suit (head hood).

The inner hood is made of an elastic and flexible material which is both water and gas proof, and which is arranged in such a way as to prevent water from penetrating from the outside around the face opening, and also to make is sufficiently tight around the neck to prevent air/gas from the suit from forcing its way into the inner hood.

However, the air/gas in the suit is intended to be able to fill the space between the inner hood and the outer hood, thus giving the head thermal insulation against the outer surroundings.

The invention does not prevent the use of underwear (headgear) between the inner hood and the outer hood, which is a supplement of the thermal protection as mentioned above.

In order to avoid rupturing of the diver's ear drums during descent, a communicating channel is provided in the inner hood for connecting air/gas from the diver's face mask to the outer ear. This channel is necessary in cases where one uses an inner hood made of a material which cannot carry air/gas to the outer ear. The channel may be omitted, however, where the inner hood has been made of an expanded (air/gas-permeable) material, as such materials will allow the transmission of small quantities of air/gas to the outer ear, sufficient to prevent rupturing of the ear drums.

The above mentioned channel is advantageously shaped like a tube in the inner hood, and at the end of the tube above the outer ear there is fitted a one-way valve which serves to keep air/gas from going both ways to avoid noise. During the ascent surplus air will escape from the outer ear into the inner hood, and from there it will pass through the face seal and out into the mask.

For a better understanding, the invention will be described by way of reference to the appended drawings.

DESCRIPTION OF A PREFERRED EMBODIMENT

Figure 1:
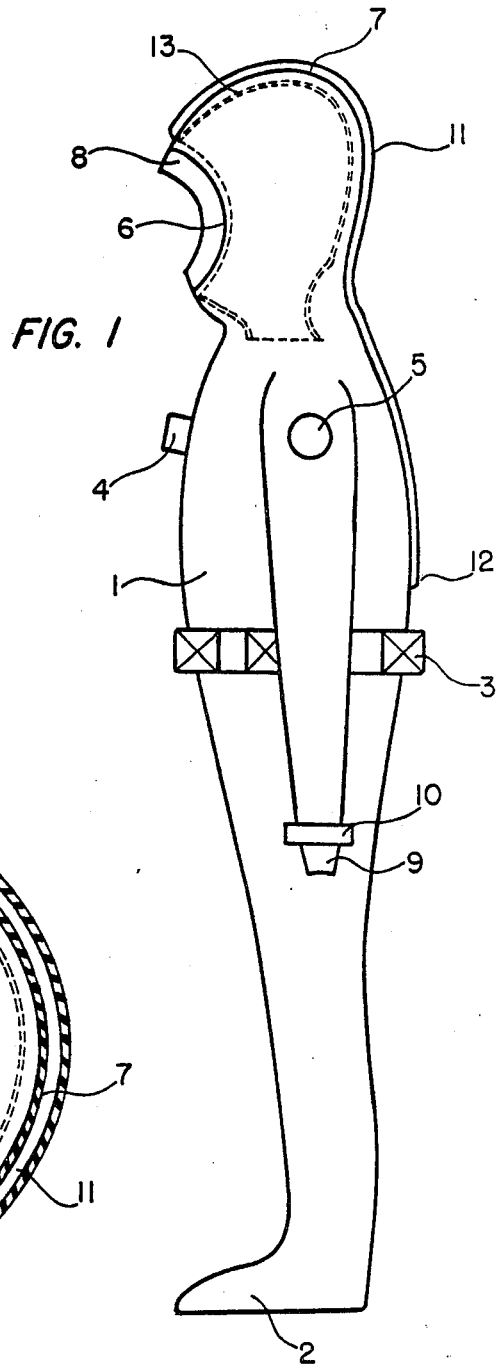
FIG. 1 is a diagrammatic side view of a variable-volume suit embodying the invention.

In this case, the variable-volume suit, also termed the overpressure suit, is made of rubber-coated textile (FIG. 1). The rubber coating may be made from natural rubber or synthetic rubber. It is also possible to use plastic-coated textiles for such suits. The textile is usually tricot material, in order to make the suit elastic and flexible in all directions. The tricot may be manufactured of natural or synthetic fibers.

As a rule the suit material is made up in two thicknesses, according to the use. The thinnest layer is called standard material and the thickest layer with a double rubber coating is called heavy-duty material.

The main suit body (FIG. 1) is sewn and the seams are sealed by vulcanizing over the top of the seams a rubber strip to make the suit water-proof and air/gas-proof. The feet 2 (one shown) are constructed in the form of a boot by making the sole extra thick. It will thus be possible to walk with the suit on, without having to worry about tearing the sole. A belt 3 may be fastened in the ordinary manner with lead weights around the waist of the suit.

To the front left side of the chest an inlet valve 4 is fitted for air or gas coming from the diver's life support system or other gas/air source. On the left upper sleeve the suit has an adjustable pressure relief valve 5. At its upper end the suit has an outer hood 7 provided with a face opening 6.

To prevent water from outside the suit from penetrating into the face opening, a piece of soft and elastic rubber 8 is fitted about the edge of the opening.

The sleeves end with a fitted cuff 9 and/or a stiff ring 10. To the latter may be fastened a loose cuff or a glove, making a water-proof seal.

The suit is furnished with a gas- and water-proof zipper 11 stretching from a point at the middle of the suit on the front of the head and following the center line of the suit along the outer hood and partway down the back. The zipper may start from a point 10–50 mm from where the outer hood 7 ends in the face opening 6 in the middle of the forehead. The zipper then goes across the head and downward along the center line of the back and ends at a point 12 above the waist.

The outer hood 7 is constructed in such a way that the material of the hood is not elastic from the head and downwards along the neck and out onto the shoulders, whereas it allows some transverse expansion, i.e., from the face opening across the ear end up to the zipper 11.

The inner hood 13 has a shape similar to that of the outer hood 7 although somewhat smaller. It is shaped approximately after the head and provided with an opening for the face, the face opening 6 of the inner hood and the face opening of the outer hood having approximately the same dimensions. The inner hood 13 narrows along the neck region and goes so far down as to fit tightly to the neck from a point somewhat above the collar bone.

The inner hood may be manufactured from expanded neoprene rubber with a thickness of 3–5 mm. However, there is nothing to prevent the inner hood from being made up of other materials, such as reinforced and non-reinforced rubber (rubber-coated textiles or pure rubber foil), expanded rubber in reinforced or nonreinforced form (expanded neoprene reinforced by textile, pure expanded rubber foil). The inner hood may also be produced of reinforced or nonreinforced plastic, such as plastic-coated textiles wherein the plastic is PVC, PU or a similar material, or as pure plastic foils of a suitable quality (softened PVC foil), PU foil or similar foils).

The inner hood is fastened to the face opening 6 of the suit 1 in such a manner as to prevent water from outside from penetrating into the suit between the inner hood 13 and the outer hood 7, nor can the air/gas in the suit penetrate through the joint connecting the hoods 7, 13.

Joining may be carried out by sewing, welding, gluing or by any other method of joining the inner hood 13 to the outer hood 7.

Figure 2:
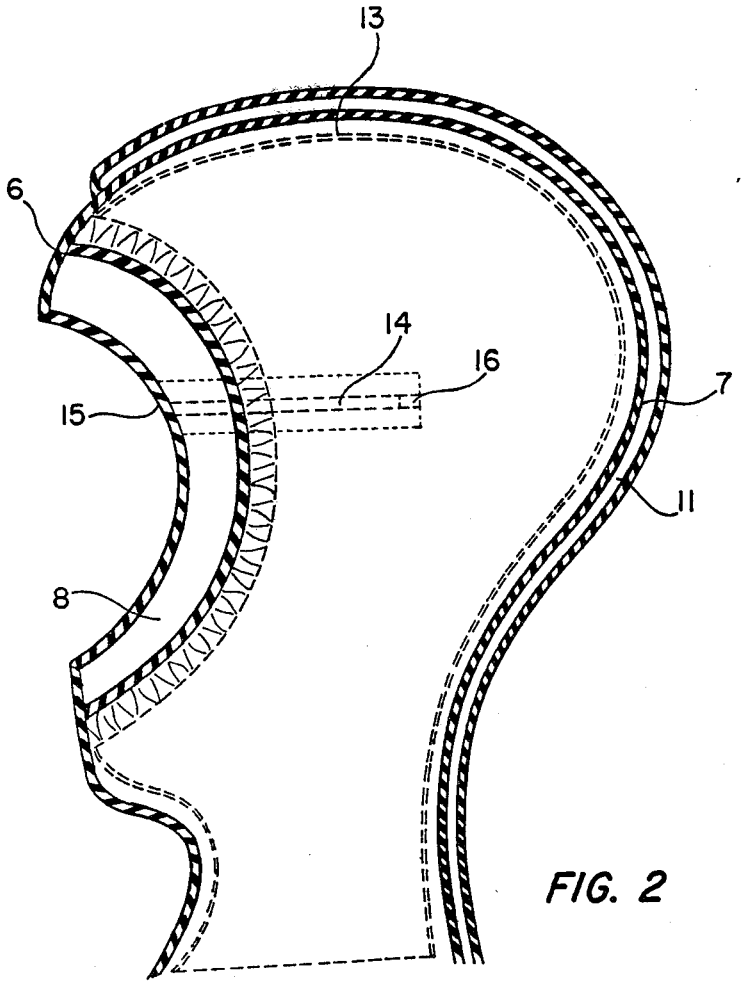
FIG. 2 is an enlarged-scale view showing details of the inner and outer hoods of the suit in FIG. 1.

The joint is so far to the front of the head as to imply in practice that the joint has been carried out in the area by and in the face opening 6.

Where necessary the inner hood 13 is provided with a channel 14 to obtain a better regulation of the pressure in the outer ear, as mentioned above. This channel starts on a level with the corner of the eye and goes back towards the outer ear (FIG. 2). Channel 14 extends from the edge 15 of the seal 8 of the face opening 6 on the inside of the inner hood 13 and on to the area above the outer ear. Here it ends in a rubber membrane working as a one-way valve 16. The valve 16 allows the flowing of air/gas through the channel 14 to the outer ear, but does not in the same manner allow the passage of air from the outer ear through the channel and out into the diver's mask. This is an advantage, inasmuch as the valve thus prevents noise coming from the mentioned channel.

To enable the diver to pull the inner hood over his head, it has been found necessary to fit the gas- and water-proof zipper 11 in a way that will make it easy for the diver to get his head into the inner hood 13; at the same time the zipper has been placed so as to expose it to the least possible wear and tear. Also, the zipper is so located so as to be as little bent as possible to keep it from breaking when the suit is taken off or put on.

Being gas- and water-proof, the present overpressure suit made of rubber-coated tricot may also be usefully employed as a gas-protective suit or as a general rescue suit.

Figure 3:
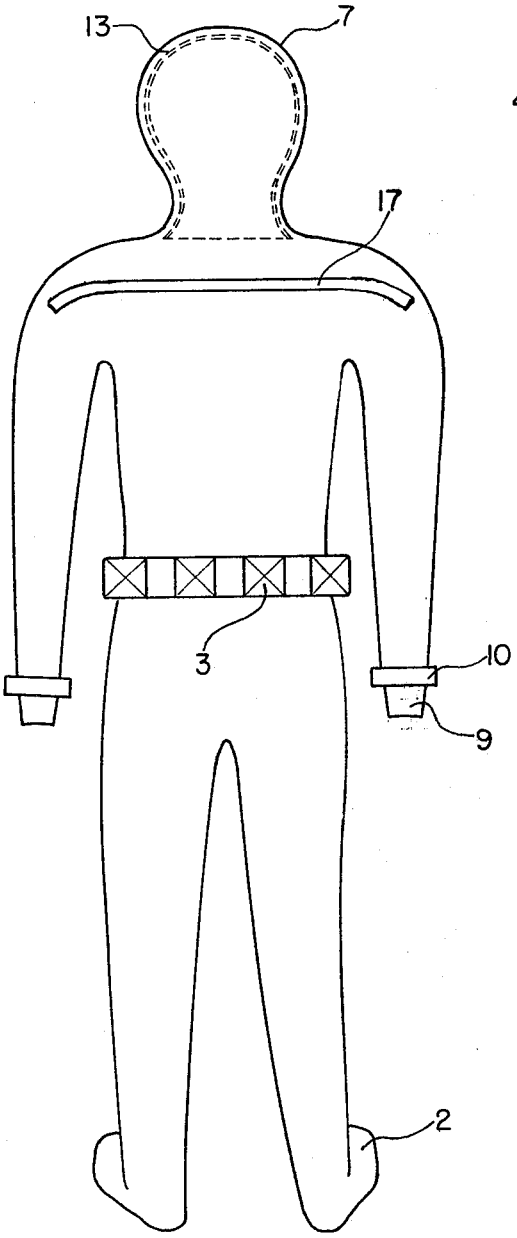
FIG. 3 is a diagrammatic rear view of a modified arrangement of the suit embodying the invention in which the zipper is placed horizontally across the back above the arm holes.

The embodiment of FIG. 3 is similar to the embodiment of FIGS. 1 and 2. Identical numerals represent identical details. The only difference is that the zipper is placed somewhat horizontally on the back of the shoulders above the armholes.

Figure 4:
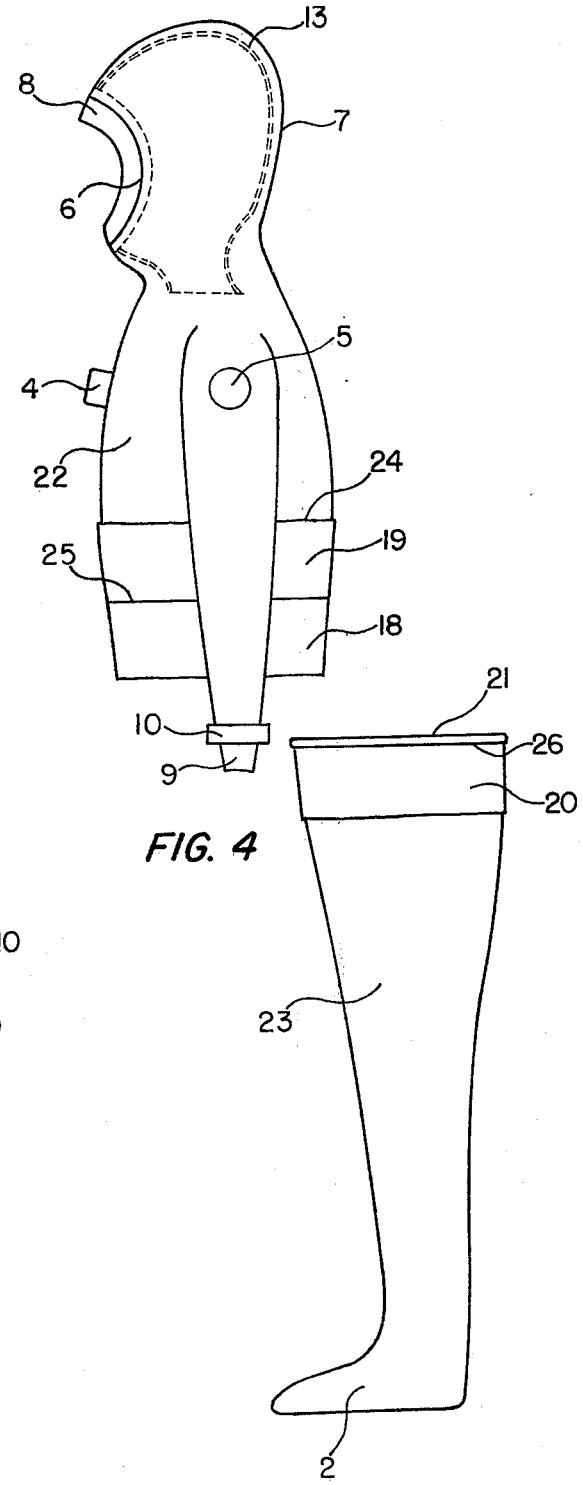
FIG. 4 is a diagrammatic side view of a further embodiment in which the body part of the suit comprises two sections separated approximately in the region of the waist.

In FIG. 4 the same numerals represent identical items.

The opening enabling the wearer to don (put on) and to take off the suit is represented by an upper section 22 and a lower section 23 of the suit.

Upper section 22 is similar to a parka and lower section 23 is similar to a pair of trousers.

In more detail:

The upper section 22 has a lower edge extension 18 below the waist. A knit portion 19 surrounds the waist of the wearer and has its lower end 25 secured to the upper section. The upper end 24 is loose to allow the turning down of the skirt to hide the extension 18.

The lower section includes a skirt 20 which is hanging down and is secured to the upper end 26. The skirt 20 is terminated by a thickened band 21.

Extensions 18 and 20, also the thickened band 21, and the skirt 19 are conveniently made of latex rubber. The other parts of the suit are made of materials like the other suits of the present invention.

The wearer turns up the skirt 19 after having put on upper section 22 and lower section 23. He then pulls the extension 18 over the extension 20 so that the thickened band is located around the hip. The extension parts 18 and 20 are rolled up and form a compact thick rubber belt surrounding the waist. The extension 19 is then turned down to hide the above-mentioned compact thick rubber belt, not shown in FIG. 4.

The two parts of the diving suit 22 and 23 are then secured by belts or other securing means, not shown in FIG. 4, to prevent separation of parts 22 and 23 upon diving.

Upon immersion into the water the pressure of the water on skirt 19 will insure on air and water-tight seal between the upper section 22 and lower section 23.

This pressure will not affect the passage of air/gas between the suit and the body of the wearer. Inlet valve 4 and outlet valve 5 will operate in the same manner as in the other embodiments.

Figure 5:
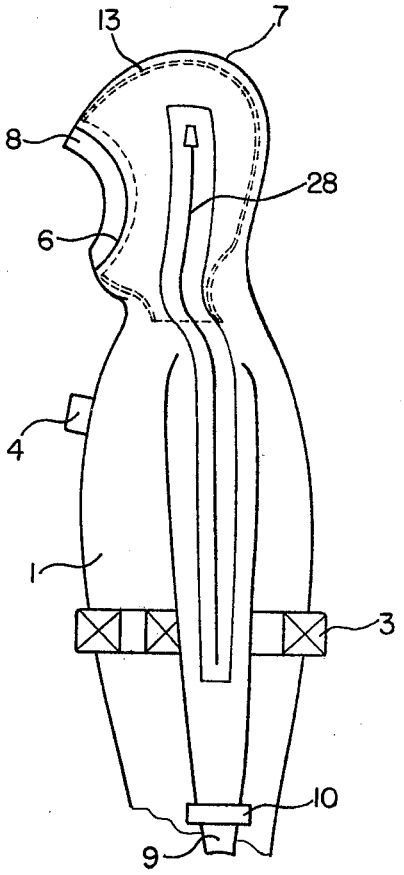
FIG. 5 is a fragmentary diagrammatic side view of a modified arrangement of the suit embodying the invention as illustrated in FIG. 1 in which the zipper is running from the side of the head part over the shoulder and downwards the arm to about the elbow.
Figure 6:
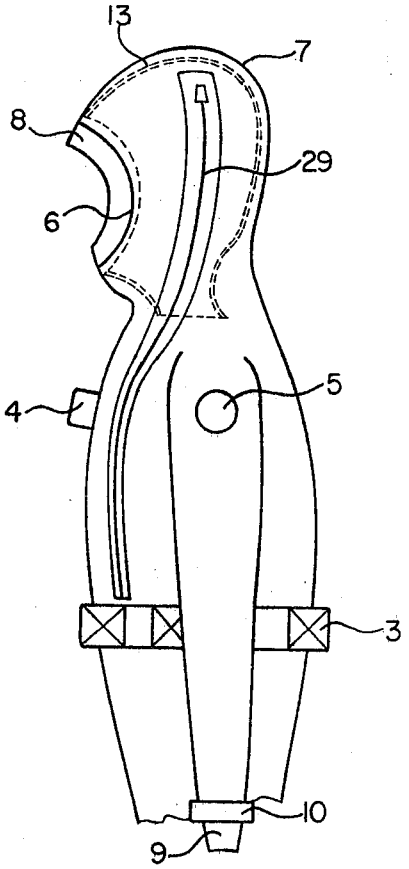
FIG. 6 is a fragmentary diagrammatic side view of a modified arrangement of the suit embodying the invention as illustrated in FIG. 1 in which the zipper is running from the side of the head part down along the neck turning to the front of the diving suit and ending in the area of the waist.

FIGS. 5 and 6 are fragmentary views of modified arrangements of the suit as illustrated in FIG. 1.

The only difference of the embodiments of FIGS. 5 and 6 is the position of the zipper.

In FIG. 5 the zipper 28 is running from the side of the head part over the shoulder and downwards the arm to about the elbow.

In FIG. 6 the zipper 29 is running from the side of the head part down along the neck turning to the front of the diving suit and ending in the area of the waist.

The other parts of the diving suit are identical with the parts illustrated and described in connection with FIG. 1. The identical parts in FIGS. 5 and 6 are given the identical numerals.

The invention has been illustrated by way of example in the drawing, and has been described with reference thereto. However, I desire not to be limited to these examples and, therefore, the limit of the protection sought by Letters Patent are to be exclusively inferred from the language of the appended claims.

We claim:

1. A dry protective water and air/gas-impervious suit adapted to cover the entire body of a wearer except the hands and face, arranged and constructed to be donned and taken off by the wearer, comprising a hood having an opening for the wearer's face;

said hood including in overlapping relationship a water and air/gas-impervious outer layer and an inner layer, said layers being sealed to one another at said face opening to define with one another an inflatable clearance surrounding the head of the wearer;

a body part covering the body of the wearer below the neck;

having an upper portion to sealingly surround the neck of the wearer and being sealingly connected to said hood;

said body part being inflatable to provide heat insulation between said body part and the body of the wearer;

means for communicating said inflatable clearance of the hood with the interior of said body part to provide insulation in form of a thermally insulating layer which surrounds the entire body of the wearer except for the hands and face;

a sealable opening in said suit to enable the wearer to don and take off said suit; and wearer-operated sealing means for sealingly closing said opening in said body part.

2. A protective suit as defined in claim 1 wherein said opening in said body part extends across the back of the wearer above the armholes, and said wearer operated sealing means comprises a gas and water-proof zipper for sealing said opening.

3. A protective suit as defined in claim 1 wherein said opening in the body part is defined by an upper section and a lower section;

said upper section extending downwardly and terminating in a lower edge extension below the waist of the wearer;

an upper skirt portion around the waist of the wearer and having its lower edge secured to said body portion;

said lower section including a lower skirt portion having an upper end secured to top part of said lower section and having;

a lower end terminating in a thickened band;

said lower section being adapted to be pulled over said upper section to surround the hip of the wearer;

said lower edge extension and said lower skirt portion being adapted to be rolled over each other to form a belt surrounding the waist of the wearer; and said upper skirt portion being adapted to cover said belt.

4. A protective suit as defined in claim 3 comprising an additional belt placed around the hip of the wearer to secure said upper section and said lower section to each other.

5. A unitary dry protective water and air/gas impervious suit adapted to cover the entire body of a wearer except the hands and the face, comprising a body part having an upper portion sealingly surrounding the neck of a wearer and covering the body below the neck;

said body part being inflatable to provide heat insulation between the body part of the suit and the body of the wearer;

a hood having an opening for the wearer's face and being sealingly connected to said upper portion;

said hood including in overlapping relationship a water and air/gas impervious outer layer; and an inner layer, said layers being sealed to one another at said face opening to define with one another an inflatable clearance surrounding the head of the wearer; and means for communicating said inflatable clearance with the interior of said body part to provide heat insulation in the form of a thermally insulating layer which surrounds the entire body of the wearer except for the face and hands;

said suit further comprising a wearer-operated gas and water-proof zipper.

6. A protective suit as defined in claim 5, wherein said zipper extends horizontally across the back of said suit above the armholes.

7. A protective suit as defined in claim 5, wherein said zipper extends from the side of the head over the shoulder down the arm to about the elbow.

8. A protective suit as defined in claim 5, wherein said zipper extends from the side of the head down along the neck then turning to the front of said suit and ending in the area of the waist.

9. A protective suit as defined in claims 1 or 5, wherein said inner hood is of a material which is slightly permeable to air/gas so as to permit some of the air/gas from said layer to escape to the ears of a user and thereby prevent rupturing of the user's eardrums.

10. A protective suit as defined in claims 1 or 5, wherein said suit is made of flexible elastically yieldable materials, said materials including textile-reinforced synthetic plastic material.

11. A protective suit as defined in claims 1 or 5, wherein said suit is made of flexible elastically yieldable materials, said materials including textile-reinforced by a layer of natural rubber on the outside.

12. A protective suit as defined in claims 1 or 5, wherein said suit is made of flexible elastically yieldable materials, said materials including textile-reinforced natural rubber.

13. A protective suit as defined in claims 1 or 5, wherein said suit is made of flexible elastically yieldable materials, said materials including textile-reimforced synthetic rubber.

14. A protective suit as defined in claims 1 or 5, wherein said suit is made of flexible elastically yieldable materials, said materials including synthetic rubber.

15. A protective suit as defined in claims 1 or 5, wherein said suit is made of flexible elastically yieldable materials, said materials including synthetic plastic material.

16. A protective suit as defined in claims 1 or 5, wherein said suit is made of flexible elastically yieldable materials, said materials including expanded elastromeric material.

17. A protective suit as defined in claims 1 or 5, wherein said suit is made of flexible elastically yieldable materials, said materials including non-expanded elastomeric material.

18. A protective suit as defined in claims 1 or 5 wherein said inner hood is made of air/gas-impermeable material;

and further comprising means for preventing rupturing of the eardrum of a user of the suit.

19. A protective suit as defined in claim 18, said means comprising a channel on said inner hood having an open end positioned to be located opposite an ear of a user who is wearing the suit, and another open end adapted to communicate with the face mask of the user so that air/gas can travel from the mask to the ear of the user.

20. A protective suit as defined in claim 19, said means further comprising a one-way valve in said channel.

21. A dry protective water and air-gas impervious suit adapted to cover the entire body of the wearer except the hands and face, arranged and constructed to be donned and taken off by the wearer comprising an upper section covering the upper part of the wearer, extending downwardly below the waist of the wearer and including a hood portion having an opening for the wearer's face;

said hood portion including in overlapping relationship a water and air-gas impervious outer layer and an inner layer said layers being sealed to one another at said face opening to define with one another an inflatable clearance surrounding the head of the wearer;

a lower section covering the body of the wearer from the waist downward;

securing means for securing sealingly said upper portion to said lower portion;

said portions being inflatable to provide heat insulation between said portions and the body of the wearer; and means for communicating said inflatable clearance of the hood with the interior of said portions to provide insulation in form of a thermally insulating layer which surrounds the entire body of the wearer except for the hands and face.

* * * * *